US008774660B2

(12) United States Patent
Fujishima

(10) Patent No.: US 8,774,660 B2
(45) Date of Patent: Jul. 8, 2014

(54) IMAGE FORMING APPARATUS CAPABLE OF PRINTING LONG SHEETS

(75) Inventor: Masashi Fujishima, Osaka (JP)

(73) Assignee: Kyocera Document Solutions Inc. (JP)

( * ) Notice: Subject to any disclaimer, the term of this patent is extended or adjusted under 35 U.S.C. 154(b) by 124 days.

(21) Appl. No.: 13/547,491

(22) Filed: Jul. 12, 2012

(65) Prior Publication Data

US 2013/0022365 A1 Jan. 24, 2013

(30) Foreign Application Priority Data

Jul. 21, 2011 (JP) ..... 2011-159552

(51) Int. Cl.
*G03G 15/06* (2006.01)
*G03G 15/08* (2006.01)
*G03G 21/00* (2006.01)

(52) U.S. Cl.
CPC ..... *G03G 15/065* (2013.01); *G03G 15/0808* (2013.01); *G03G 15/0806* (2013.01); *G03G 21/00* (2013.01); *G03G 2215/00734* (2013.01)
USPC ..... 399/55; 399/283; 399/273; 399/384

(58) Field of Classification Search
CPC ..... G03G 15/6517; G03G 2215/00223; G03G 2215/00455
USPC ..... 399/384, 55, 283, 285
See application file for complete search history.

(56) References Cited

U.S. PATENT DOCUMENTS 7,139,522 B2 * 11/2006 Ohki et al. ..... 399/384

FOREIGN PATENT DOCUMENTS

JP 2005-55837 3/2005
JP 2005-55840 3/2005

* cited by examiner

*Primary Examiner* — David Gray
*Assistant Examiner* — Carla Therrien
(74) *Attorney, Agent, or Firm* — Gerald E. Hespos; Michael J. Porco; Matthew T. Hespos

(57) ABSTRACT

An image forming apparatus includes a separating unit for performing a stripping operation of forcibly returning toner particles carried on a toner bearing member to a developer bearing member, a sheet size discriminator for discriminating whether a sheet is a standard sized sheet or a long sheet, a determiner for determining whether or not there is any blank area of a predetermined length or longer in the sub scanning direction, where no toner image is to be substantially transferred, for each long sheet, and a controller for controlling the stripping operation. The controller causes the separating unit to perform the stripping operation at a developing timing of an electrostatic latent image corresponding to the blank area to be formed on the image bearing member when the sheet is a long sheet and when the blank area of the predetermined length or longer is present.

5 Claims, 11 Drawing Sheets

STANDARD SIZED SHEET
DEVELOPING OPERATION

STANDARD SIZED SHEET
BETWEEN SHEETS

LONG SHEET
PRINTING AREA
E1

LONG SHEET
BLANK AREA/BETWEEN SHEETS
E2

LONG SHEET
NO BLANK AREA
E3
DEVELOPING ROLLER

STANDARD SIZED SHEET
BETWEEN SHEETS

LONG SHEET
BETWEEN SHEETS

IMAGE FORMING APPARATUS CAPABLE OF PRINTING LONG SHEETS

This application is based on Japanese Patent Application Serial No. 2011-159552 filed with the Japan Patent Office on Jul. 21, 2011, the contents of which are hereby incorporated by reference.

BACKGROUND

The present disclosure relates to an image forming apparatus for transferring a toner image to a sheet and particularly to an image forming apparatus capable of transferring a toner image to a long sheet larger than A3 size.

An image forming apparatus such as a copier, a printer or a facsimile machine utilizing an electrophotographic method forms a toner image on an image bearing member (e.g. photoconductive drum or transfer belt) by supplying a developer to an electrostatic latent image formed on the image bearing member and developing the electrostatic latent image. A touch-down developing method using a two-component developer containing nonmagnetic toner particles and magnetic carrier particles is known as one of developing method. A two-component developer layer (so-called magnetic brush layer) is carried on a magnetic roller, the toner particles are received from the magnetic brush layer and a toner layer is carried on a developing roller, and the toner particles are supplied from the toner layer to an image bearing member, thereby visualizing the electrostatic latent image.

In a developing device adopting the touch-down development method, it is known to perform a stripping operation of forcibly collecting toner particles once carried on the developing roller by the magnetic brush layer on the magnetic roller by changing a bias applied to the developing roller every time one sheet is printed. By performing this stripping operation, it is possible to suppress deterioration of the toner particles associated with the stay of the toner particles on the developing roller for a long time.

Some of image forming apparatuses can print not only standard sized sheets such as A4 and A3 sheets, but also long sheets, the size of which in a sub scanning direction is 1000 mm or longer. Since a developing time per sheet becomes longer in printing such long sheets, a toner layer is carried on a developing roller for a longer time. Thus, even if the stripping operation is performed between sheets, the toner particles on the developing roller may be excessively charged during a transfer process for one long sheet and a transfer failure (image defect) such as a solid image blank area may occur.

An object of the present disclosure is to prevent the occurrence of an image defect associated with deterioration of toner particles in an image forming apparatus capable of transferring a toner image to a long sheet.

SUMMARY

An image forming apparatus according to one aspect of the present disclosure includes an image bearing member, a developer housing, a developer bearing member, a toner bearing member, a separating unit, a sheet size discriminator, a determiner and a controller.

The image bearing member bears an electrostatic latent image and a toner image to be transferred to a sheet. The developer housing stores a developer containing toner particles and carrier particles. The developer bearing member receives the developer in the developer housing and bears a developer layer while rotating in a predetermined direction.

The toner bearing member receives the toner particles from the developer layer and bears a toner layer while rotating in contact with the developer layer and supplies the toner particles of the toner layer to the image bearing member to develop the electrostatic latent image. The separating unit performs a stripping operation of forcibly returning the toner particles carried on the toner bearing member to the developer bearing member. The sheet size discriminator discriminates whether the sheet to which the toner image is to be transferred is a standard sized sheet or a long sheet, the size of which in a sub scanning direction is longer than the standard sized sheet. The determiner determines whether or not there is any blank area of a predetermined length or longer in the sub scanning direction where no toner image is to be substantially transferred based on image data, from which the toner image is to be formed, for each long sheet. The controller controls the stripping operation.

The controller causes the separating unit to perform the stripping operation at a developing timing of the electrostatic latent image corresponding to the blank area to be formed on the image bearing member when the sheet size discriminator discriminates the sheet, to which the toner image is to be transferred, to be the long sheet and when the determiner determines the presence of the blank area of the predetermined length or longer.

These and other objects, features and advantages of the present disclosure will become more apparent upon reading the following detailed description along with the accompanying drawings.

DETAILED DESCRIPTION

Figure 1:
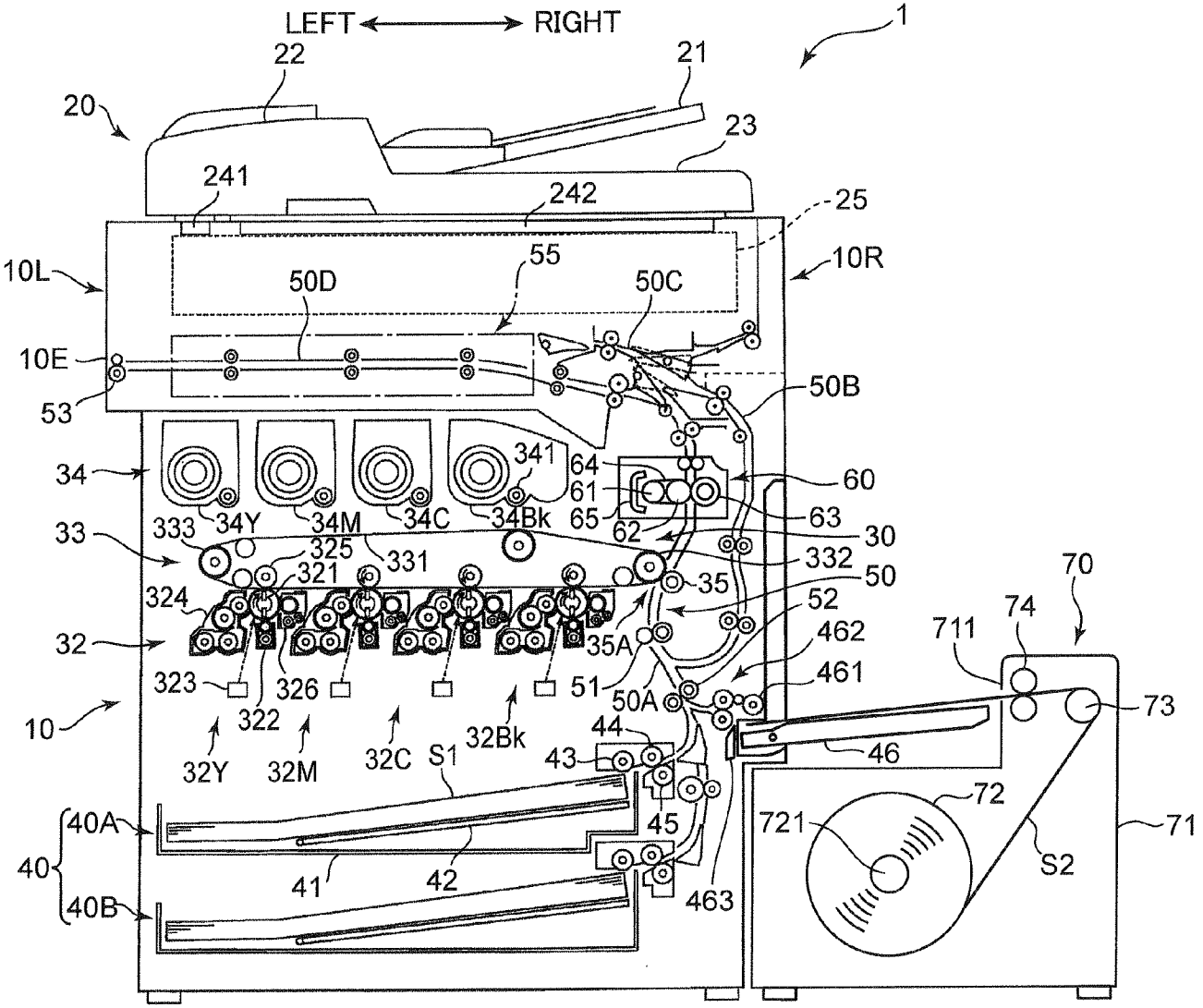
FIG. 1 is a sectional view showing one embodiment of an image forming apparatus according to the present disclosure.

Hereinafter, an embodiment of the present disclosure is described in detail based on the drawings. FIG. 1 is a sectional view showing the internal structure of an image forming apparatus 1 according to one embodiment of the present disclosure. Although a complex machine with a printer function and a copier function is illustrated as the image forming apparatus 1 here, the image forming apparatus may also be a printer, a copier or a facsimile machine.

The image forming apparatus 1 includes an apparatus main body 10 having a substantially rectangular parallelepipedic housing structure, an automatic document feeder 20 arranged on the apparatus main body 10, and an external cassette 70 attached to a lower part of a right side surface 10R of the apparatus main body 10 and adapted to feed long sheets. In the apparatus main body 10 are housed a reading unit 25 for optically reading a document image to be copied, an image forming station 30 for forming a toner image on a sheet, a fixing unit 60 for fixing the toner image to the sheet, a sheet feeder unit 40 for storing standard sized sheets to be conveyed to the image forming station 30, a conveyance path 50 for conveying a standard sized sheet or a long sheet from the sheet feeder unit 40 or the external cassette 70 to a sheet discharge opening 10E via the image forming station 30 and the fixing unit 60, and a conveying unit 55 including a sheet conveyance path constituting a part of the conveyance path 50 inside.

The automatic document feeder (ADF) 20 is rotatably mounted on the upper surface of the apparatus main body 10. The ADF 20 automatically feeds a document sheet to be copied toward a predetermined document reading position (position where a first contact glass 241 is mounted) in the apparatus main body 10. On the other hand, when a user manually places a document sheet on a predetermined document reading position (position where a second contact glass 242 is arranged), the ADF 20 is opened upwardly. The ADF 20 includes a document tray 21 on which document sheets are to be placed, a document conveying unit 22 for conveying a document sheet via an automatic document reading position, and a document discharge tray 23 to which the document sheet after reading is to be discharged.

A reading unit 25 optically reads an image of a document sheet via the first contact glass 241 for reading a document sheet automatically fed from the ADF 20 on the upper surface of the apparatus main body 10 or the second contact glass 242 for reading a manually placed document sheet. A scanning mechanism including a light source, a moving carriage, a reflecting mirror and the like and an image pickup device (not shown) are housed in the reading unit 25. The scanning mechanism irradiates a document sheet with light and introduces its reflected light to the image pickup device. The image pickup device photoelectrically converts the reflected light into an analog electrical signal. The analog electrical signal is input to the image forming station 30 after being converted into a digital electrical signal in an A/D conversion circuit.

The image forming station 30 performs a process of generating a full-color toner image and transferring it to a sheet and includes image forming units 32 composed of four tandemly arranged units 32Y, 32M, 32C and 32B for forming toner images of yellow (Y), magenta (M), cyan (C) and black (Bk), an intermediate transfer unit 33 arranged above and adjacent to the image forming units 32 and a toner supply unit 34 arranged above the intermediate transfer unit 33.

Each of the image forming units 32Y, 32M, 32C and 32Bk includes a photoconductive drum 321 (image bearing member), and a charger 322, an exposure device 323, a developing device 324, a primary transfer roller 325 and a cleaning device 326 arranged around this photoconductive drum 321.

The photoconductive drum 321 rotates about its shaft and an electrostatic latent image and a toner image are formed on the circumferential surface thereof. A photoconductive drum made of amorphous silicon (a-Si) material can be used as the photoconductive drum 321. The charger 322 uniformly charges the surface of the photoconductive drum 321. The exposure device 323 includes optical devices such as a laser light source, a mirror and a lens and irradiates the circumferential surface of the photoconductive drum 321 with light based on image data of a document image to form an electrostatic latent image.

The developing device 324 supplies toner to the circumferential surface of the photoconductive drum 321 to develop the electrostatic latent image formed on the photoconductive drum 321. The developing device 324 is for a two-component developer and includes a screw feeder, a magnetic roller and a developing roller. This developing device 324 is described in detail later.

The primary transfer roller 325 forms a nip portion together with the photoconductive drum 321 by sandwiching an intermediate transfer belt 331 provided in the intermediate transfer unit 33 and primarily transfers a toner image on the photoconductive drum 321 to the intermediate transfer belt 331. The cleaning device 326 includes a cleaning roller and the like and cleans the circumferential surface of the photoconductive drum 321 after the transfer of a toner image.

The intermediate transfer unit 33 includes the intermediate transfer belt 331, a drive roller 332 and a driven roller 333. The intermediate transfer belt 331 is an endless belt mounted between the drive roller 332 and the driven roller 333, and toner images are transferred to the outer circumferential surface of the intermediate transfer belt 331 in a superimposition manner at the same position from a plurality of photoconductive drums 321 (primary transfer).

A secondary transfer roller 35 is arranged to face the circumferential surface of the drive roller 332. A nip portion between the drive roller 332 and the secondary transfer roller 35 serves as a secondary transfer portion 35A where a full-color toner image superimposed on the intermediate transfer belt 331 is transferred to a sheet. A secondary transfer bias potential having a polarity opposite to that of the toner image is applied to either one of the drive roller 332 and the secondary transfer roller 35 and the other roller is grounded.

The toner supply unit 34 includes a yellow toner container 34Y, a magenta toner container 34M, a cyan toner container 34C and a black toner container 34Bk. These toner containers 34Y, 34C, 34M and 34Bk are for storing toner particles of the respective colors and supply the toner particles of the respective colors to the developing devices 324 of the image forming units 32Y, 32M 32C and 32Bk corresponding to the respective colors Y, M, C and Bk via unillustrated supply paths. Each of the toner containers 34Y, 34C, 34M and 34Bk includes a conveying screw 341 for conveying the toner particles in the container to an unillustrated toner discharge opening. This conveying screw 341 is driven and rotated by a driver unit 962 (FIG. 6), whereby the toner particles are supplied into the developing device 324.

The sheet feeder unit 40 includes sheet cassettes 40A, 40B arranged in two levels and adapted to store standard sized sheets S1 out of sheets on which an image forming process is to be performed. These sheet cassettes 40A, 40B can be withdrawn forward from the front side of the apparatus main body 10. In this specification, "standard sized sheets" are of a size, for example, in accordance with A series or B series defined by ISO216 and indicate sheets of a size generally used in general image forming apparatuses. For example, sheets of A3, A4, A5, B4, B5 size or the like are the standard sized sheets S1. Of course, size standards may conform to standards other than ISO216. For example, the standard sized sheets may be, for example, those based on standards such as ANSI, LDR, LGL, Folio, Quarto, Letter, EXEC and STMT.

The sheet cassette 40A (40B) includes a sheet storage portion 41 for storing a stack of sheets formed by stacking the standard sized sheets S1 one over another and a lift plate 42 for lifting up the sheet stack for sheet feeding. A pickup roller 43 and a pair of a feed roller 44 and a retard roller 45 are arranged above the right end of the sheet cassette 40A (40B). By driving the pickup roller 43 and the feed roller 44, the uppermost sheet S1 of the sheet stack in the sheet cassette 40A is fed one by one and conveyed to an upstream end of the conveyance path 50.

A sheet feed tray 46 for manual sheet feeding is provided on the right side surface 10R of the apparatus main body 10. The sheet feed tray 46 is openably and closably mounted to the apparatus main body 10 at its lower end part. In the case of manually feeding a sheet, a user opens the sheet feed tray 46 as shown and places the sheet thereon. The sheet placed on the sheet feed tray 46 is conveyed into the conveyance path 50 by driving the pickup roller 461 and the feed roller 462. Note that an example in which this sheet feed tray 46 is used as a tray for feeding a long sheet S2 is illustrated in this embodiment.

The external cassette 70 is a sheet cassette optionally attached to the apparatus main body 10 for feeding a long sheet S2. The external cassette 70 includes a housing 71 with a sheet feed opening 711. A rolled paper sheet 72 which is a roll of a long sheet is housed in the housing 71. A roll core of the roller paper sheet 72 is mounted on a rotary shaft 721 and the long sheet S2 is dispensed from the rolled paper sheet 72 by driving the rotary shaft 721. The long sheet S2 is fed onto the sheet feed tray 46 from the sheet feed opening 711 by a pair of feed rollers 74 via a folding driven roller 73.

In the case of causing the long sheet S2 to be fed, the user first opens the sheet feed tray 46, dispenses the long sheet S2 a predetermined length from the rolled paper sheet 72 and nips the leading end of this sheet between the pickup roller 461 and an unillustrated friction pad arranged right below. Thereafter, the long sheet S2 is conveyed to the conveyance path 50 by driving the pickup roller 461 and the feed 462 similarly to the above manual sheet feeding. A cutter 463 for cutting the long sheet S2 to a predetermined length is arranged near the feed roller 462. A cutter configured such that a moving body fitted with a cutting blade is moved in a width direction of the sheet can be adopted as the cutter 463.

In this specification, the "long sheet" indicates a sheet, the size of which in a sub scanning direction is longer than standard sized sheets and means sheets, the size of which in the sub scanning direction are longer than A3 size sheets or equivalent sheets to A3 in this embodiment. The size of the long sheet in the sub scanning direction is, for example, about 500 mm to 1500 mm.

The conveyance path 50 includes a main conveyance path 50A for conveying a sheet (standard sized sheet S1 or long sheet S2) from the sheet feeder unit 40 to the exit of the fixing unit 60 via the image forming station 30, a reversing conveyance path 50B for returning a sheet having one side printed to the image forming station 30 in the case of printing both sides of a sheet, a switchback conveyance path 50C for conveying the sheet from a downstream end of the main conveyance path 50A toward an upstream end of the reversing conveyance path 50B, and a horizontal conveyance path 50D for conveying the sheet in a horizontal direction from the downstream end of the main conveyance path 50A to the sheet discharge opening 10E provided on a left side surface 10L of the apparatus main body 10. Most of this horizontal conveyance path 50D is formed by the sheet conveyance path provided in the conveying unit 55.

A pair of registration rollers 51 are arranged at a side of the main conveyance path 50A upstream of the secondary transfer portion 35A. A sheet is temporarily stopped by the pair of registration rollers 51 in a stopped state for skew correction. Thereafter, the pair of registration rollers 51 are driven and rotated by a drive motor (not shown) at a predetermined timing for image transfer, whereby the sheet is fed to the secondary transfer portion 35A. Besides, a plurality of conveyor rollers 52 for conveying the sheet are arranged in the main conveyance path 50A. The same applies to the other conveyance paths 50B, 50C and 50D.

A discharge roller 53 is arranged at the most downstream end of the conveyance path 50. The discharge roller 53 feeds the sheet to an unillustrated post-processing apparatus arranged next to the left side surface 10L of the apparatus main body 10 through the sheet discharge opening 10E. Note that a sheet discharge tray is provided below the sheet discharge opening 10E in an image forming apparatus to which the post-processing apparatus is not attached.

The conveying unit 55 is a unit for conveying a sheet exiting from the fixing unit 60 to the sheet discharge opening 10E. In the image forming apparatus 1 of this embodiment, the fixing unit 60 is arranged at a side near the right side surface 10R of the apparatus main body 10, and the sheet discharge opening 10E is arranged at a side near the left side surface 10L of the apparatus main body 10 facing the right side surface 10R. Accordingly, the conveying unit 55 conveys the sheet in the horizontal direction from the right side surface 10R toward the left side surface 10L of the apparatus main body 10.

The fixing unit 60 is a fixing device of an induction heating type for performing a fixing process of fixing a toner image to a sheet, and includes a heating roller 61, a fixing roller 62, a pressure roller 63, a fixing belt 64 and an induction heating unit 65. The pressure roller 63 is pressed into contact with the fixing roller 62, thereby forming a fixing nip portion. The heating roller 61 and the fixing belt 64 are induction-heated by the induction heating unit 65 and apply that heat to the fixing nip portion. The sheet passes through the fixing nip portion, whereby the toner image transferred to the sheet is fixed to the sheet.

Figure 2:
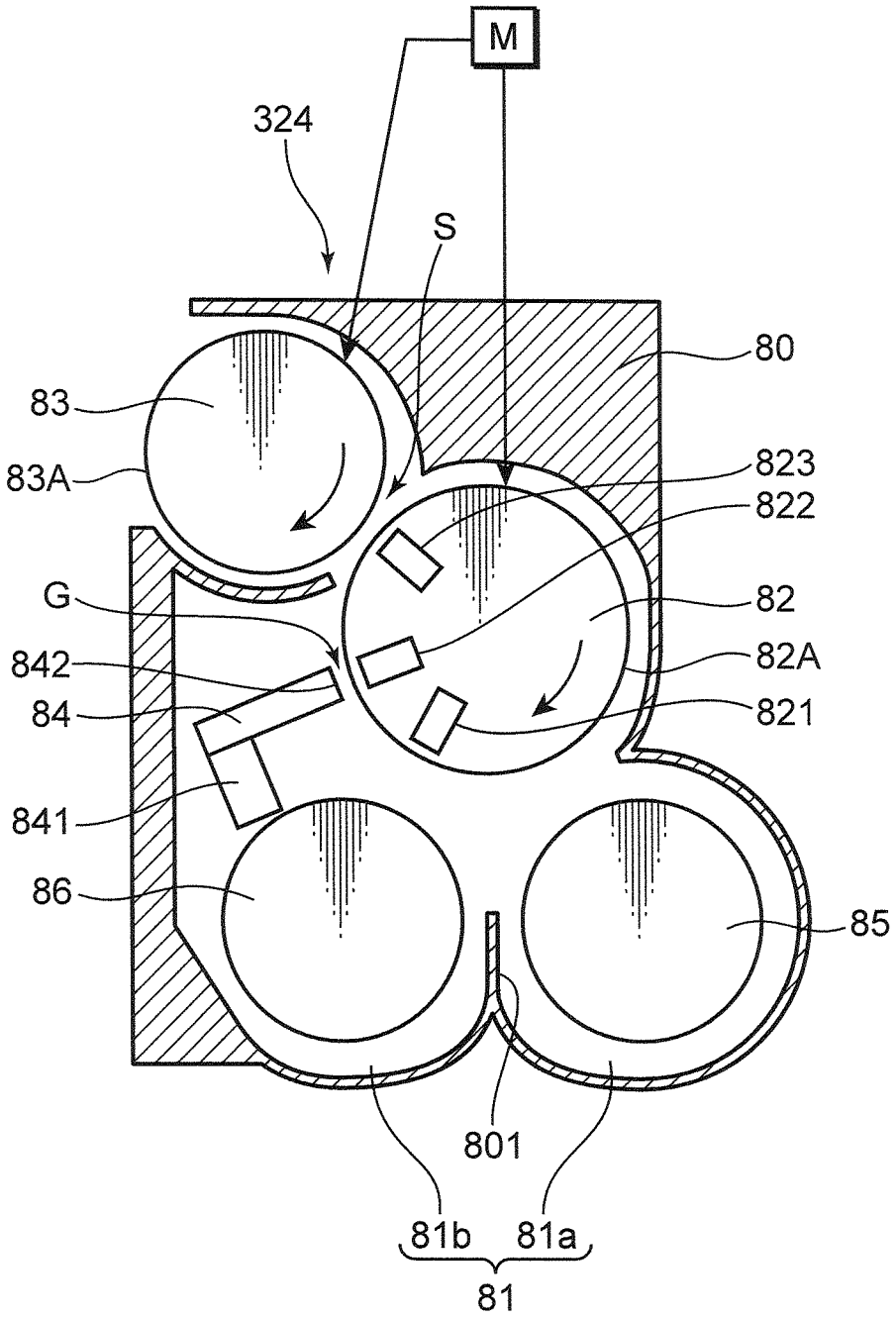
FIG. 2 is a vertical sectional view of a developing device.
Figure 3:
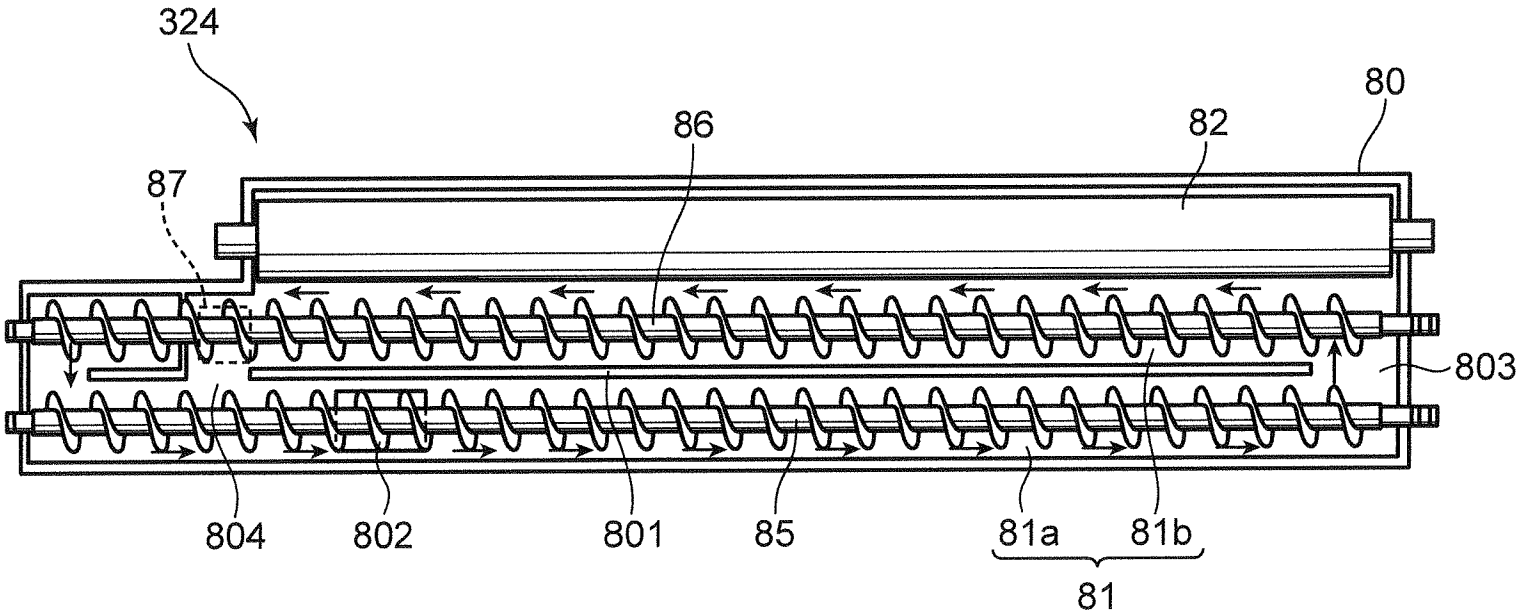
FIG. 3 is a horizontal sectional view of the developing device.

Next, the developing device 324 is described in detail. FIG. 2 is a vertical sectional view of the developing device 324, and FIG. 3 is a horizontal sectional view of the developing device 324. The developing device 324 includes a developer housing 80 defining the internal space of the developing device 324. This developer housing 80 includes a developer storing portion 81 which is a cavity for storing a developer containing nonmagnetic toner particles and magnetic carrier particles and capable of conveying the developer while agitating it. Further, a magnetic roller 82 (developer bearing member) arranged above the developer storing portion 81, a developing roller 83 (toner bearing member) arranged to face the magnetic roller 82 at a position obliquely above the magnetic roller 82 and a developer restricting blade 84 arranged to face the magnetic roller 82 are included in the developer housing 80.

The developer storing portion 81 includes two adjacent developer storage chambers 81*a*, 81*b* extending in a longitudinal direction of the developing device 324. The developer storage chambers 81*a*, 81*b* are integrally formed to the developer housing 80 and partitioned by a partition plate 801 extending in the longitudinal direction, but communicate with each other via communication paths 803, 804 at both ends in the longitudinal direction as shown in FIG. 3. Screw feeders 85, 86 for agitating and conveying the developer by rotating about a shaft is accommodated in the respective developer storage chambers 81, 81*b*. The screw feeders 85, 86 are driven and rotated by an unillustrated driving mechanism and the rotating directions thereof are set to be opposite to each other. In this way, the developer is conveyed in a circulating manner while being agitated between the developer storage chambers 81*a* and 81*b* as shown by arrows in FIG. 3. By this agitation, the toner particles and the carrier particles are mixed and the toner particles are, for example, negatively charged.

The magnetic roller 82 is arranged along the longitudinal direction of the developing device 324 and rotatable clockwise in FIG. 2. A fixed so-called magnetic roll (not shown) is arranged in the magnetic roller 82. The magnetic roll includes a plurality of magnetic poles and, in this embodiment, includes a scoop-up pole 821, a restricting pole 822 and a main pole 823. The scoop-up pole 821 faces the developer storing portion 81, the restricting pole 822 faces the developer restricting blade 84 and the main pole 823 faces the developing roller 83.

The magnetic roller 82 magnetically scoops up (receives) the developer from the developer storing portion 81 onto a circumferential surface 82A thereof by a magnetic force of the scoop-up pole 821. The scooped-up developer is magnetically held as a developer layer (magnetic brush layer) on the circumferential surface 82A of the magnetic roller 82 and conveyed toward the developer restricting blade 84 according to the rotation of the magnetic roller 82.

The developer restricting blade 84 is arranged upstream of the developing roller 83 in a rotating direction of the magnetic roller 82 and restricts the layer thickness of the developer layer magnetically adhering to the circumferential surface 82A of the magnetic roller 82. The developer restricting blade 84 is a plate member made of a magnetic material and extending in a longitudinal direction of the magnetic roller 82 and supported by a predetermined supporting member 841 fixed at a suitable position of the developer housing 80. Further, the developer restricting blade 84 has a restricting surface 842 (i.e. leading end surface of the developer restricting blade 84) for forming a restricting gap G of a predetermined dimension between the circumferential surface 82A of the magnetic roller 82 and the restricting surface 842.

The developer restricting blade 84 made of the magnetic material is magnetized by the restricting pole 822 of the magnetic roller 82 and a magnetic path is formed between the restricting surface 842 of the developer restricting blade 84 and the restricting pole 822, i.e. in the restricting gap G. When the developer layer adhering to the circumferential surface 82A of the magnetic roller 82 by the action of the scoop-up pole 821 is conveyed into the restricting gap G according to the rotation of the magnetic roller 82, the layer thickness of the developer layer is restricted in the restricting gap G. In this way, a uniform developer layer of a predetermined thickness is formed on the circumferential surface 82A.

The developing roller 83 is arranged to extend along the longitudinal direction of the developing device 324 and in parallel to the magnetic roller 82 and rotatable clockwise in FIG. 2. The developing roller 83 has a circumferential surface 83A which receives the toner particles from the developer layer and bears a toner layer while rotating in contact with the developer layer held on the circumferential surface 82A of the magnetic roller 82. When a developing operation is performed, the toner particles of the toner layer are supplied to the circumferential surface of the photoconductive drum 321.

The developing roller 83 and the magnetic roller 82 are rotated and driven by a drive source M. A clearance S of a predetermined dimension is formed between the circumferential surface 83A of the developing roller 83 and the circumferential surface 82A of the magnetic roller 82. The clearance S is set, for example, at about 130 μm. The developing roller 83 is arranged to face the photoconductive drum 321 through an opening formed in the developer housing 80, and a clearance of a predetermined dimension is also formed between the circumferential surface 83A and the circumferential surface of the photoconductive drum 321.

Figure 6:
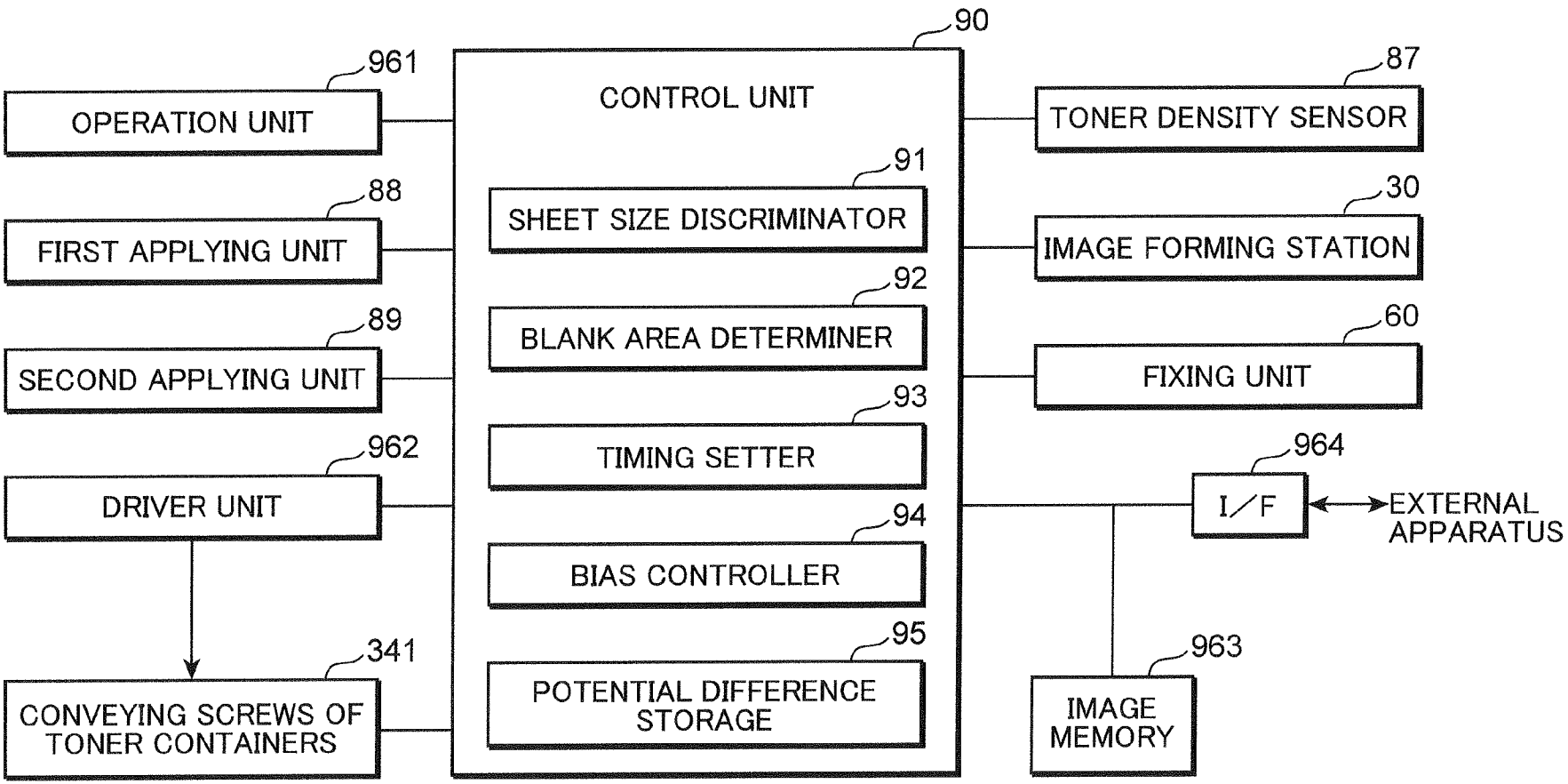
FIG. 6 is a functional block diagram of a control unit.

As shown in FIG. 3, a toner density sensor 87 for measuring the density of the toner particles in the developer housing 80 is arranged in the developer housing 80. The toner density sensor 87 includes, for example, a magnetic permeability sensor for measuring magnetic permeability, and outputs a voltage corresponding to the magnetic permeability that varies according to the toner density. An output of the toner density sensor 87 is expressed, for example, in 10 bits and indicated as a value of 0 to 1023. Since the toner particles are a nonmagnetic substance in this embodiment, an output bit value increases as the toner density decreases and, conversely, the output bit value decreases as the toner density increases. The output of the toner density sensor 87 is given to a control unit 90 (FIG. 6).

Figure 4:
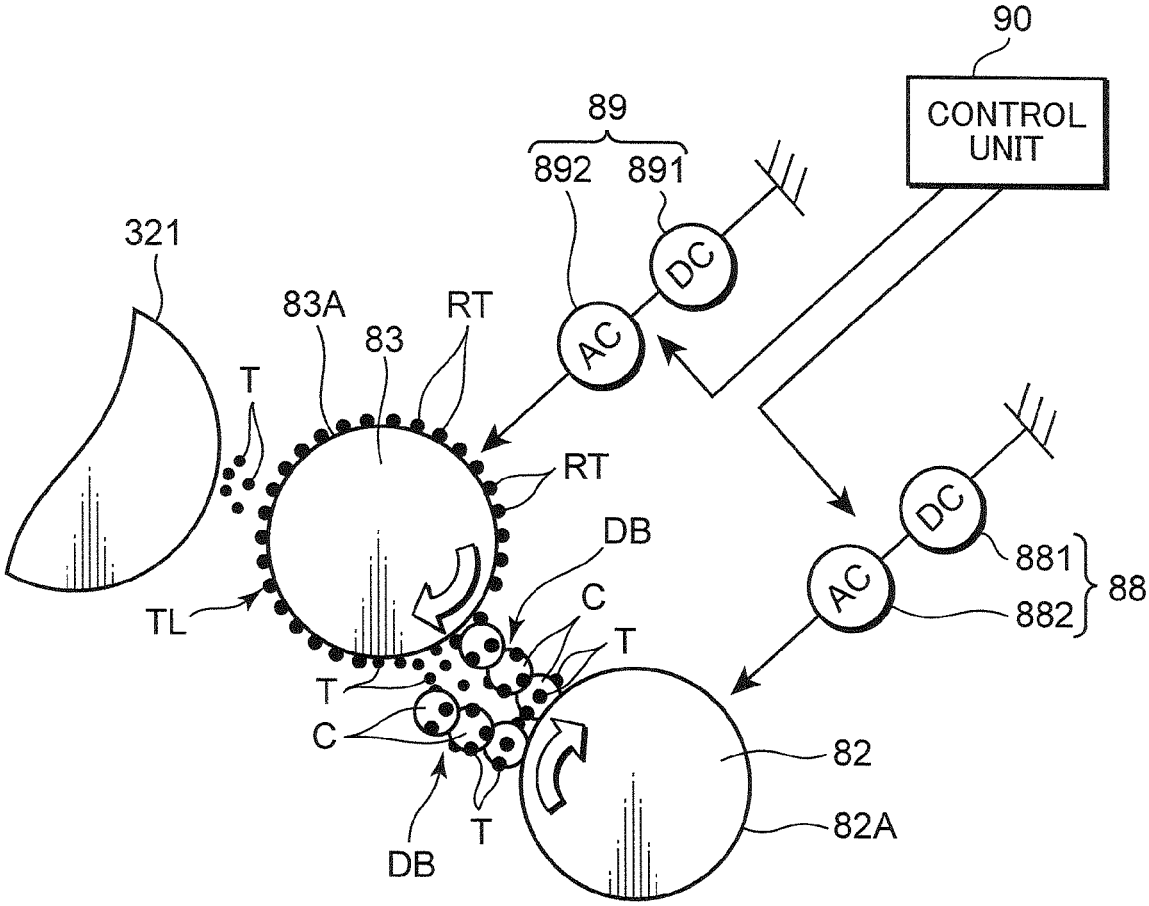
FIG. 4 is a schematic diagram showing a developing operation of the developing device.

Next, a configuration for bias application and a developing operation of the developing device 324 are described with reference to FIG. 4. The developing device 324 further includes a first applying unit 88, a second applying unit 89 and the control unit 90 for controlling the first and second applying units 88, 89 (separating portion/bias applying unit) to control the developing operation. As shown in FIG. 4, the first applying unit 88 includes a DC voltage source 881 and an AC voltage source 882 connected in series and is connected to the magnetic roller 82. A voltage obtained by superimposing an AC bias output from the AC voltage source 882 on a DC bias output from the DC voltage source 881 is applied to the magnetic roller 82. The second applying unit 89 includes a DC voltage source 891 and an AC voltage source 892 connected in series and is connected to the developing roller 83. A voltage obtained by superimposing an AC bias output from the AC voltage source 892 on a DC bias output from the DC voltage source 891 is applied to the developing roller 83.

The DC biases and the AC biases applied to the magnetic roller 82 and the developing roller 83 are changed at the time of a developing operation of supplying toner particles onto the circumferential surface of the photoconductive drum 321 (developing an electrostatic latent image) by the developing device 324 and during an interval between sheets from the completion of an image forming process for one sheet to the start of the image forming process for the next sheet. In this embodiment, the first and second applying units 88, 89 are controlled to apply developing biases different from developing biases for standard sized sheets depending on whether image data from which a toner image is to be formed includes or does not include a predetermined blank image area when a sheet to which the toner image is to be transferred is a long sheet. This point will be described in detail later.

A mechanism for developing an electrostatic latent image on the photoconductive drum 321 is described. A magnetic brush layer DB on the circumferential surface 82A of the magnetic roller is conveyed toward the developing roller 83 according to the rotation of the magnetic roller 82 after the layer thickness thereof is uniformly restricted by the developer restricting blade 84. Thereafter, a multitude of magnetic brushes DB in the magnetic brush layer come into contact with the circumferential surface 83A of the developing roller 83 in an area of the clearance S (FIG. 2).

At this time, the control unit 90 controls the first and second applying units 88, 89 to apply predetermined DC biases and AC biases respectively to the magnetic roller 82 and the developing roller 83. This results in a predetermined potential difference between the circumferential surface 82A of the magnetic roller 82 and the circumferential surface 83A of the developing roller 83. By this potential difference, only toner particles T move to the circumferential surface 83A from the magnetic brushes DB at a position where the circumferential surfaces 82A, 83A face each other (position where the main pole 823 (FIG. 2) and the circumferential surface 83A face each other) and carrier particles C of the magnetic brushes DB remain on the circumferential surface 82A. In this way, a toner layer TL of a predetermined thickness is borne on the circumferential surface 83A of the developing roller 83.

The toner layer TL on the circumferential surface 83A is conveyed toward the circumferential surface of the photoconductive drum 321 according to the rotation of the developing roller 83. Since a superimposed voltage of an AC voltage and a DC voltage is also applied to the photoconductive drum 321, there is a predetermined potential difference between the circumferential surface of the photoconductive drum 321 and the circumferential surface 83A of the developing roller 83. By this potential difference, the toner particles T of the toner layer TL move to the circumferential surface of the photoconductive drum 321 (supply of the toner particles). In this way, the electrostatic latent image on the circumferential surface of the photoconductive drum 321 is developed to form a toner image.

Figure 5:
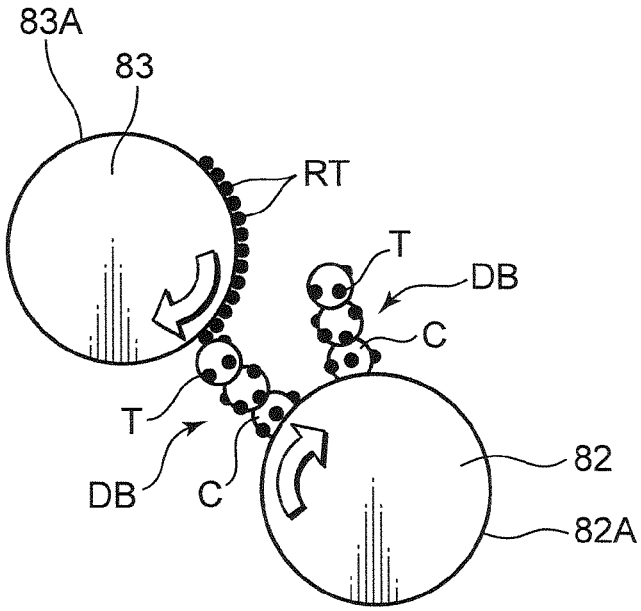
FIG. 5 is a diagram showing an operation of stripping toner particles from a developing roller.

FIG. 5 is a schematic diagram showing a toner particle stripping operation from the developing roller 83 to the magnetic roller 82. This stripping operation is performed at an interval between sheets in conventional image forming apparatuses. In addition to this, in this embodiment, if image data for a long sheet includes a blank area of a predetermined length or longer in the sub scanning direction where a toner image is not substantially transferred, the stripping operation is also performed at a developing timing of an electrostatic latent image corresponding to the blank area.

In an actual developing operation, out of the toner particles T in the toner layer TL, there are residual toner particles RT remaining on the circumferential surface 83A without moving to the photoconductive drum 321. The residual toner particles RT are collected by a scraping force by the magnetic brushes DB and an electrical force between the two rollers 82, 83 when being conveyed to the position, where the circumferential surface 83A and the circumferential surface 82A of the magnetic roller 82 face each other, according to the rotation of the developing roller 83. The magnetic brushes DB including the collected residual toner particles RT are separated from the circumferential surface 82A by a magnetic force of a separation pole (not shown) of the magnetic roll and returned to the developer storing portion 81 (FIG. 2) when being conveyed to a side downstream of the main pole 823 according to the rotation of the magnetic roller 82.

Note that the above stripping operation is promoted by reducing the potential difference between the magnetic roller 82 and the developing roller 83. In this embodiment, the residual toner particles RT are forcibly separated from the developing roller 83 to refresh the circumferential surface 83A by temporarily reducing the potential difference at the interval between sheets and at the time of developing the blank area. Particularly, since the toner particles tend to be excessively charged and deteriorated after the developing operation is performed on the long sheet S2, it is desirable to refresh the circumferential surface by further reducing the potential difference.

Next, the electrical configuration of the image forming apparatus 1 is described. The image forming apparatus 1 includes the control unit 90 for centrally controlling the operation of the respective units of the image forming apparatus 1. FIG. 6 is a functional block diagram of the control unit 90. The control unit is composed of a CPU (Central Processing Unit), a ROM (Read Only Memory) storing a control program, a RAM (Random Access Memory) used as a work area of the CPU and the like. Further, the image forming apparatus 1 includes an operation unit 961, the driver unit 962, an image memory 963 and an I/F (interface) 964 in addition to the configuration described with reference to FIGS. 1 to 5.

The operation unit 961 includes a liquid crystal touch panel, a numerical keypad, a start key, setting keys and the like and receives operations and various settings made on the image forming apparatus 1 by the user. For example, an operation of selecting a sheet on which the image forming process is to be performed is also received in this operation unit 961.

The driver unit 962 includes a motor and a gear mechanism for transmitting a torque of the motor, and drives and rotates the conveying screws 341 provided in the toner containers 34Y, 34C, 34M and 34Bk. The driver unit 962 rotates and drives the conveying screw 341 in supplying the toner from each toner container 34Y, 34C, 34M and 34Bk to the developing device 324 arranged in correspondence therewith.

The image memory 963 temporarily stores, for example, print image data given from an external apparatus such as a personal computer when this image forming apparatus 1 functions as a printer. Further, the image memory 963 temporarily stores image data optically read by the ADF 20 when the image forming apparatus 1 functions as a copier.

The I/F 964 is an interface circuit for realizing a data communication with external apparatuses and, for example, generates a communication signal in accordance with a communication protocol of a network connecting the image forming apparatus 1 and external apparatuses and converts a communication signal from the network into data of a format processable in the image forming apparatus 1. A print instruction signal transmitted from a personal computer or the like is fed to the control unit 90 via the I/F 964 and image data is stored in the image memory 963 via the I/F 964.

The control unit 90 functions to include a sheet size discriminator 91 (sheet size discriminator), a blank area determiner 92 (determiner), a timing setter 93, a bias controller (controller) and a potential difference storage 95.

The sheet size discriminator 91 discriminates the size of a sheet to which a toner image is to be transferred. For this discrimination, the sheet size discriminator 91 refers to image data stored in the image memory 963 and determines the size of the sheet based on a data width in the sub scanning direction or the like. Whether a sheet to be printed is the long sheet S2 (S21, S22) shown in FIGS. 7A and 7B or the standard sized sheet S1 shown in FIG. 7C is discriminated by this sheet size discriminator 91. Of course, in the case of the standard sized sheet S1, the size of that standard sized sheet S1 is discriminated. Further, in the case of the long sheet S2, length information in the sub scanning direction is specified. The length information is used for a control of the dispensed amount of the long sheet S2 from the external cassette and an operation control of the cutter 463.

The blank area determiner 92 determines whether or not there is any blank area of a predetermined length or longer in the sub scanning direction, where a toner image is not to be substantially transferred, at least for the image data determined to be for printing on the long sheet S2 by the sheet size discriminator 91. An image to be formed on the long sheet S2 often includes many blank areas. For example, in the case of forming an image such as a banner including only characters, blank areas having a relatively large area are formed between the characters in some cases. The toner particles are not supplied to the photoconductive drum 321 and kept carried on the circumferential surface 83A of the developing roller 83 at a developing timing of the blank area. If the above toner particle stripping timing between sheets is waited, the residence time of the toner layer on the circumferential surface 83A becomes longer and the toner particles are deteriorated. Further, since the "blank area" has to be formed on the long sheet, the toner particles of the toner layer cannot be discharged toward the photoconductive drum 321. Accordingly, in this embodiment, the stripping operation of forcibly returning the toner particles on the developing roller 83 toward the developing roller 82 is performed at the developing timing of the blank area. The blank area determiner 92 determines the presence or absence of a blank area in image data to discriminate whether or not the stripping operation can be performed.

A method for dividing the image data by a predetermined width (e.g. about 10 mm) in the sub scanning direction and evaluating whether or not a divided section is a blank section based on whether or not the number of effective pixels (pixels determined to be other than white) in each section is substantially zero can be adopted as a method for detecting the blank area. Further, the presence of the blank area of the predetermined length can also be determined based on the continuity of the blank section in the sub scanning direction. The predetermined length of this blank area in the sub scanning direction is desirably the circumferential length of one turn of the developing roller 83. In this case, the toner particles can be stripped over the entire circumference of the circumferential surface 83A of the developing roller 83 and the circumferential surface 83A can be refreshed in a satisfactory manner.

Figure 7A:
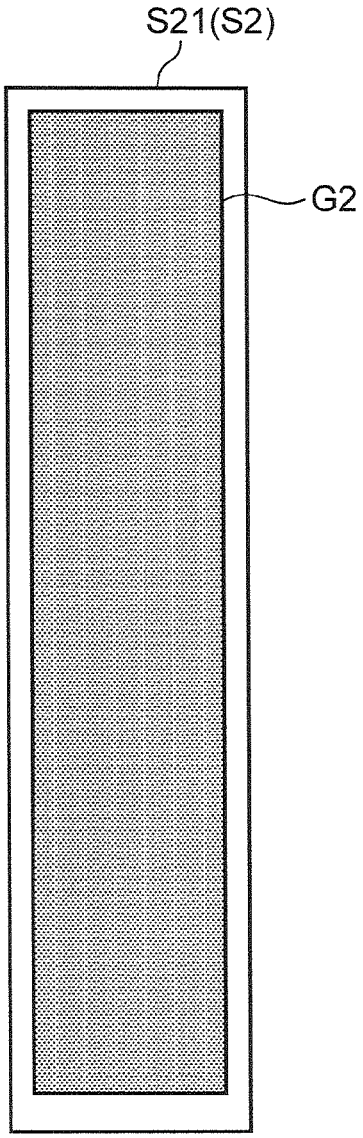
FIGS. 7A and 7B are diagrams showing long sheets and FIG. 7C is a diagram showing a standard sized sheet.
Figure 7B:
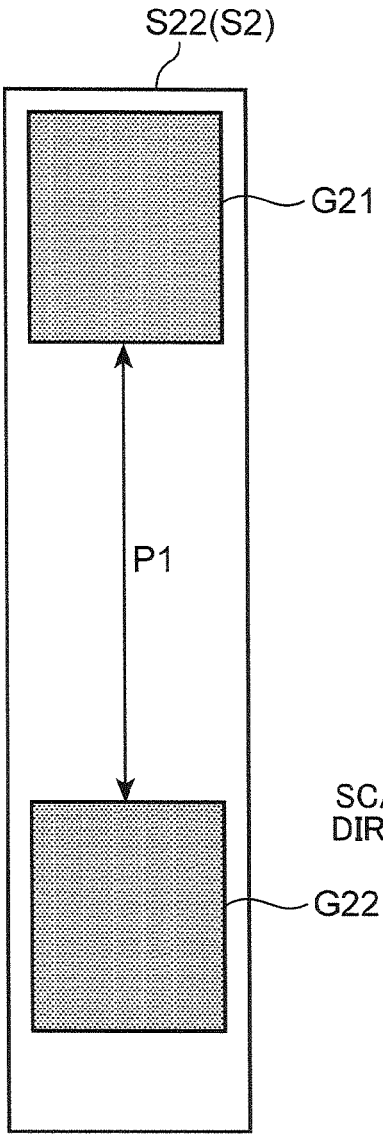
Figure 7C:
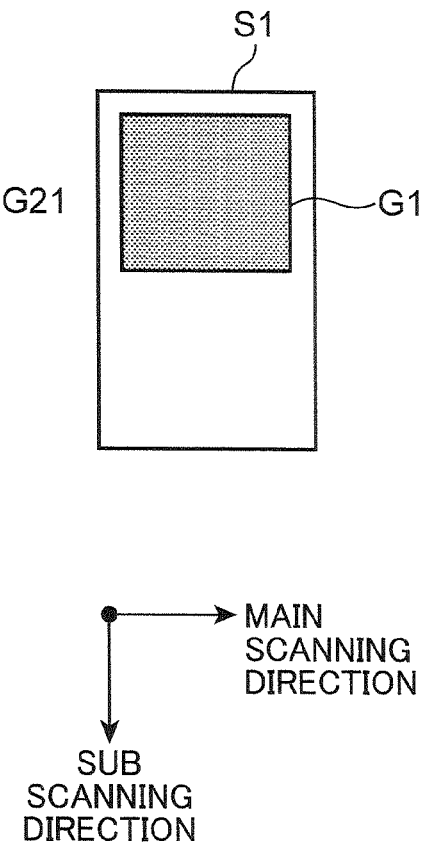

A long sheet S21 shown in FIG. 7A shows an example in which a toner image G2 continuous in the sub scanning direction is formed. In this case, the blank area determiner 92 outputs a determination signal to the effect that the "blank area is not present" to the bias controller 94. On the other hand, a long sheet S22 shown in FIG. 7B shows an example in which toner images G21, G22 (printing areas) separated from each other in the sub scanning direction are formed. In this case, the blank area determiner 92 outputs a determination signal to the effect that the "blank area is present" to the bias controller 94 and outputs coordinate information on image data which can specify the width of a blank area P1 between the toner images G21, G22 to the timing setter 93. FIG. 7C shows a standard sized sheet S1 to which a toner image G1 is to be transferred. For such a standard sized sheet S1, the blank area determiner 92 does not determine the presence or absence of a blank area. This is because the developing roller 83 can be refreshed by a stripping operation generally performed at the interval between sheets since the width of the standard sized sheet S1 is short in the sub scanning direction. Of course, the presence or absence of a blank area may be determined also for the standard sized sheet S1.

The timing setter 93 calculates a developing bias changing timing based on the coordinate information of the blank area P1 on the image data fed from the blank area determiner 92 and outputs the calculated timing information to the bias controller 94. That is, the timing setter 93 replaces the coordinate information of the blank area P1 by the timing information on the start and end of the blank area P1 on the photoconductive drum 321 and links the developing bias control.

The bias controller 94 controls the developing operation by the developing device 324 and the toner particle stripping operation by controlling biases applied to the magnetic roller 82 and the developing roller 83 by the first and second applying units 88, 89. The bias controller 94 changes the potential difference between the magnetic roller 82 and the developing roller 83 depending on whether the image data is for the standard sized sheet S1 or for the long sheet S2 and whether or not any blank area is included in the case of the long sheet S2.

The potential difference storage 95 stores the biases at the time of the developing operation and those at the time of the stripping operation set by the bias controller 94 and set values of the potential difference between the magnetic roller 82 and the developing roller 83 under various conditions. The biases and the set values of the potential difference stored in the potential difference storage 95 are illustrated below.

Figure 8A:
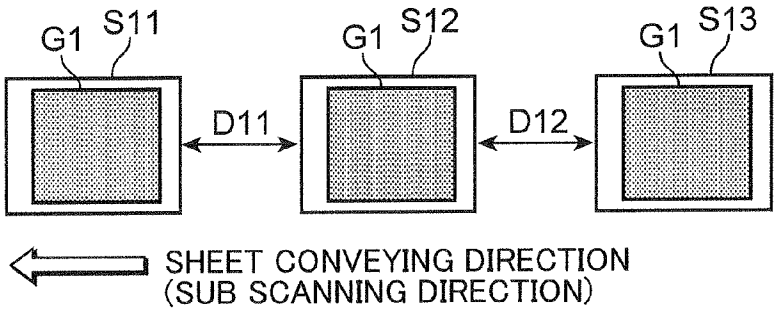
FIGS. 8A, 8B and 8C are diagrams showing patterns of successively printing sheets.
Figure 8B:
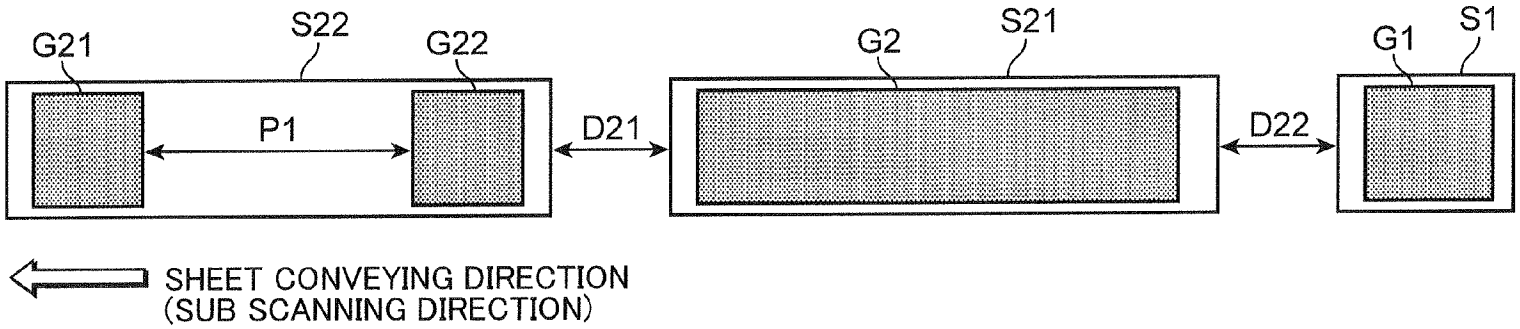
Figure 8C:
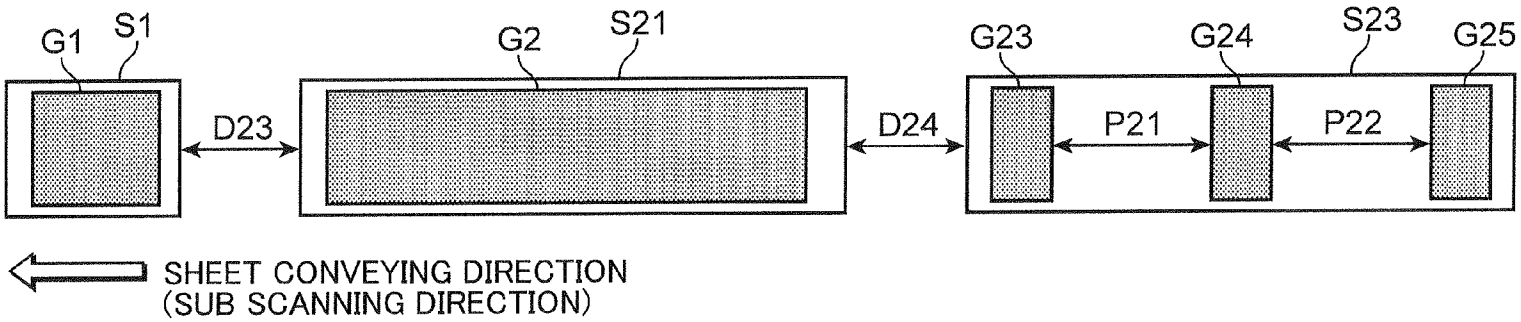

FIGS. 8A to 8C are diagrams showing patterns of successively printing sheets. FIG. 8A shows an example in which a plurality of standard sized sheets S1 (S11, S12, S13) are successively printed, FIG. 8B shows an example in which one standard sized sheet S1 is printed after two long sheets S2 (S21, S22) are successively printed, and FIG. 8C shows an example in which two long sheets S2 (S21, S23) are printed after one standard sized sheet S1 is printed.

Figures 9A, 9B:
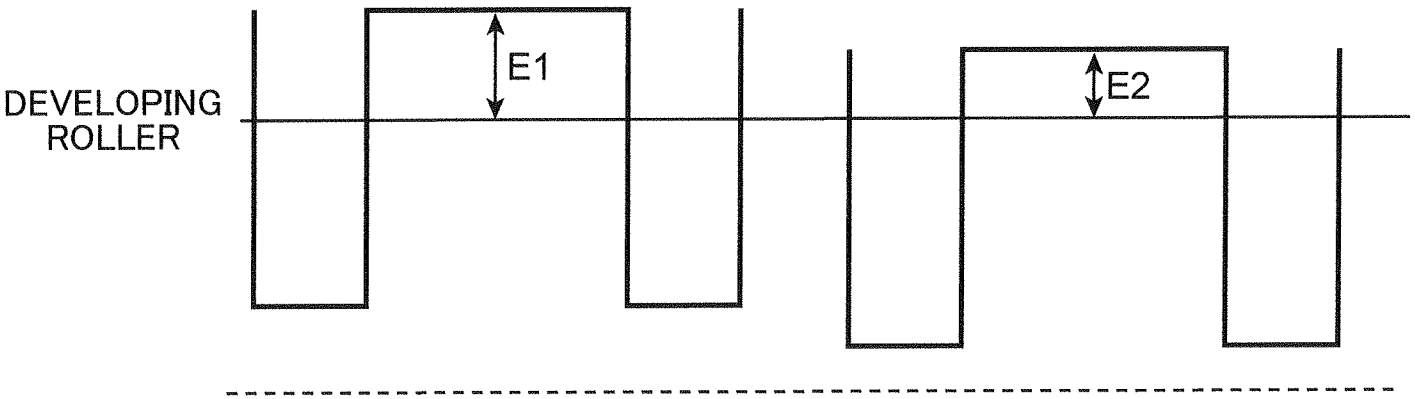
FIGS. 9A and 9B are time charts showing examples of developing bias waveforms during a process of printing standard sized sheets.

FIGS. 9A and 9B show bias waveforms when the standard sized sheets S11, S12 and S13 are successively printed as shown in FIG. 8A. FIG. 9A shows a developing bias waveform (bias waveform of the magnetic roller 82 when viewed form the developing roller 83) applied at a developing timing for each sheet and FIG. 9B shows a stripping bias waveform applied when residual toner particles on the developing roller 83 are collected to the magnetic roller 82 at the intervals between the respective sheets. As shown in FIGS. 9A and 9B, the bias controller 94 sets a potential difference E2 at the time of stripping (between sheets) to be smaller than a potential difference E1 between the magnetic roller 82 and the developing roller 83 at the time of development.

An example of a developing bias Ba1 caused to be applied to the magnetic roller 82 and the developing roller 83 through the first and second applying units 88, 89 at the time of development by the bias controller 94 is as follows.

DC bias Vmag_dc of the magnetic roller 82; 350 V
DC bias Vslv_dc of the developing roller 83; 50 V
AC bias Vmag_ac of the magnetic roller 82; 2500 V (4.7 kHz)
AC bias Vslv_ac of the developing roller 83; 1500 V (4.7 kHz)
Bias duty ratio of the photoconductive drum 321 to the developing roller 83; 43%
Bias duty ratio of the developing roller 83 to the magnetic roller 82; 70%

On the other hand, an example of a stripping bias Ba2 set to strip toner particles at the interval between sheets by the bias controller 94 is as follows. Note that the AC biases Vmag_ac, Vslv_ac and the duty ratios are the same as above.

DC bias Vmag_dc of the magnetic roller 82; 150 V
DC bias Vslv_dc of the developing roller 83; 50 V As described above, the potential difference E2 different (reduced) from the potential difference E1 of the developing bias Ba1 by the predetermined value is set at the interval between sheets. This causes the toner particles stripped from the circumferential surface 83A of the developing roller 83 by the magnetic brushes DB on the magnetic roller 82 to be collected onto the magnetic roller 82 by an electrical force. In the case of successively printing the standard sized sheets S11, S12 and S13 as show in FIG. 8A, the bias controller 94 causes the above developing bias Ba1 (bias waveform of FIG. 9A) to be applied to the magnetic roller 82 and the developing roller 83 at the developing timing of the standard sized sheet S11. The same applies also at the developing timings of the standard sized sheets S12, S13. The bias controller 94 causes the above stripping bias Ba2 (bias waveform of FIG. 9B) to be applied to the magnetic roller 82 and the developing roller 83 during inter-sheet intervals D11, D12.

Figures 10A, 10B, 10C:
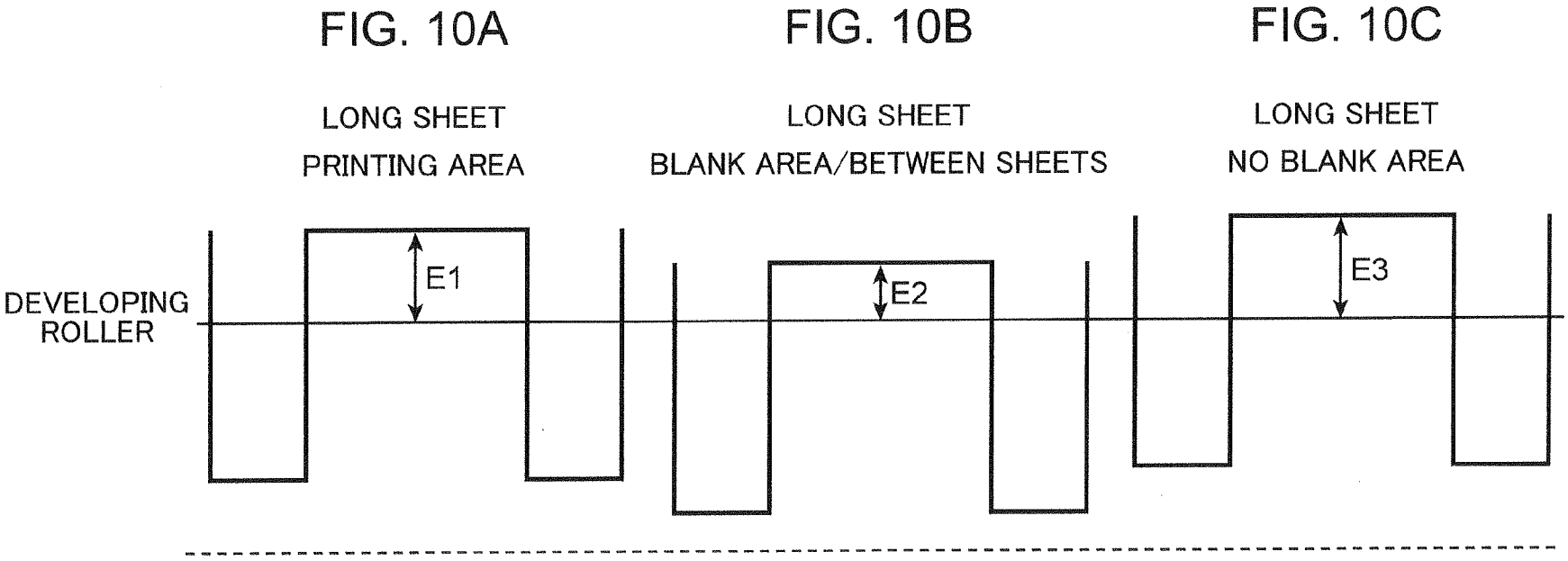
FIGS. 10A, 10B and 10C are time charts showing examples of developing bias waveforms during a process of printing long sheets.

FIGS. 10A to 10C show bias waveforms in the case of successively printing long sheets. FIG. 10A shows the waveform of a first developing bias Bb1 (bias waveform of the magnetic roller 82 when viewed from the developing roller 83) applied to printing areas (formation areas G21, G22 illustrated in FIG. 7B) of each long sheet at developing timings. FIG. 10B shows the waveform of a stripping bias Bc applied in collecting residual toner particles on the developing roller 83 to the magnetic roller 82 at a developing timing of a blank area (blank area P1 illustrated in FIG. 7B) on one long sheet or at an interval between sheets after the printing process for a long sheet. FIG. 10C shows the waveform of a second developing bias Bb2 applied at a developing timing of a long sheet including no blank area.

During the process of printing one long sheet including a blank area, the bias controller 94 changes the potential difference between the magnetic roller 82 and the developing roller 83 and causes the stripping operation to be performed to collect toner particles from the magnetic roller 82 at a developing timing of an electrostatic latent image corresponding to the blank area. That is, the bias controller 94 applies a bias having the potential difference E2 (second potential difference) smaller than the potential difference E1 (first potential difference) between the magnetic roller 82 and the developing roller 83 in the first developing bias Bb1 applied at a developing timing of a printing area as the stripping bias Bc at the developing timing of the blank area. The above potential difference E2 is the same as the potential difference set at an interval between sheets after the printing process for a long sheet.

On the other hand, the bias controller 94 controls to apply the second developing bias Bb2, with which the potential difference between the magnetic roller 82 and the developing roller 83 is a potential difference E3 (third potential difference) which is larger than the potential difference E1 by a predetermined value and enables a thicker toner layer to be formed on the circumferential surface 83A of the developing roller 83, at the developing timing of the long sheet when the long sheet is determined not to include any blank area.

Such a control is executed to prevent a reduction in developing property. That is, since the stripping operation is not performed when no blank area is present on one long sheet, the toner particles on the developing roller 83 may be possibly excessively charged. In this case, the toner particles may insufficiently move to the photoconductive drum 321 and the developing property may be reduced. Accordingly, the above potential difference is set at the third potential difference at which a thicker toner layer can be formed on the developing roller 83, thereby increasing the suppliable amount of toner particles and suppressing a reduction in the developing property.

An example of the first developing bias Bb1 applied to the magnetic roller 82 and the developing roller 83 through the first and second applying units 88, 89 at a developing timing of a printing area by the bias controller 94 at the time of developing a long sheet including a blank area is as follows. In this embodiment, this is the same as the developing bias Ba1 applied at a developing timing of a standard sized sheet.

DC bias Vmag_dc of the magnetic roller 82; 350 V
DC bias Vslv_dc of the developing roller 83; 50 V
AC bias Vmag_ac of the magnetic roller 82; 2500 V (4.7 kHz)
AC bias Vslv_ac of the developing roller 83; 1500 V (4.7 kHz)
Bias duty ratio of the photoconductive drum 321 to the developing roller 83; 43%
Bias duty ratio of the developing roller 83 to the magnetic roller 82; 70%

On the other hand, an example of the stripping bias Bc set to strip toner particles by the bias controller 94 at the developing timing of the blank area or at the interval between sheets after the printing process for a long sheet is as follows. Note that the AC biases Vmag_ac, Vslv_ac and the duty ratios are the same as first developing bias Bb1.

DC bias Vmag_dc of the magnetic roller 82; 150 V
DC bias Vslv_dc of the developing roller 83; 50 V Further, an example of the second developing bias Bb2 applied at a developing timing of a long sheet including no blank area by the bias controller 94 is as follow. Note that the AC biases Vmag_ac, Vslv_ac and the duty ratios are the same as the first developing bias Bb1.

DC bias Vmag_dc of the magnetic roller 82; 400 V
DC bias Vslv_dc of the developing roller 83; 50 V Here, a specific example of bias setting by the bias controller 94 is described based on printing examples shown in FIGS. 8B and 8C. In the example of FIG. 8B, the long sheet S22 including the blank area P1 is a first print target. The bias controller 94 causes the first developing bias Bb1 to be applied for the printing areas G21, G22 of the long sheet S22 and causes the stripping bias Bc to be applied for the blank area P1. During an inter-sheet interval D21 after the printing process for the long sheet S22, the above stripping bias Bc is applied.

The long sheet S21 to be printed next is a long sheet including no blank area. In this case, the bias controller 94 causes the second developing bias Bb2 to be applied at a developing timing of a printing area G2 of the long sheet S21. During an inter-sheet interval D22 after the printing process for the long sheet S21, the above stripping bias Bc is applied. A sheet to be printed next is the standard sized sheet S1. Thus, the bias controller 94 causes the above developing bias Ba1 (same as the first developing bias Bb1) to be applied at a developing timing of the standard sized sheet S1.

Next, in the example of FIG. 8C, the standard sized sheet S1 is a first print target. Accordingly, the bias controller 94 causes the above developing bias Ba1 to be applied at a developing timing of the standard sized sheet S1. During a following inter-sheet interval D23, the above stripping bias Ba2 (same as the stripping bias Bc) is applied.

A sheet to be printed next is the long sheet S21 including no blank area. Accordingly, the bias controller 94 causes the second developing bias Bb2 to be applied at a developing timing of the printing area G2 of the long sheet S21. During a following inter-sheet interval D24, the above stripping bias Bc is applied. Next, the long sheet S23 including three printing areas G23, G24 and G25 and two blank areas P21, P22 between these printing areas is to be printed. In this case, the bias controller 94 causes the first developing bias Bb1 to be applied at developing timings of the printing areas G23, G24 and G25 and causes the stripping bias Bc to be applied for the blank areas P21, P22.

Here, a preferred modification of the stripping bias applied at inter-sheet interval is described. As described above, when the printing process for a long sheet is performed, there is a possibility that the toner particles on the developing roller 83 are deteriorated and adversely affect the developing property. In the above examples, it is highly possible that the deteriorated toner particles remain on the developing roller 83 after the printing process for the long sheet S21 including no blank area. Although the stripping operation is performed during the printing process for the long sheets S22, S23 including the blank areas, the deteriorated toner particles can similarly remain on the developing roller 83 in the case of relatively small blank areas. Thus, it is desirable to reliably strip the toner particles from the developing roller 83 and reliably refresh the circumferential surface 83A at an interval between sheets after the printing process for these long sheets.

Figures 11A, 11B:
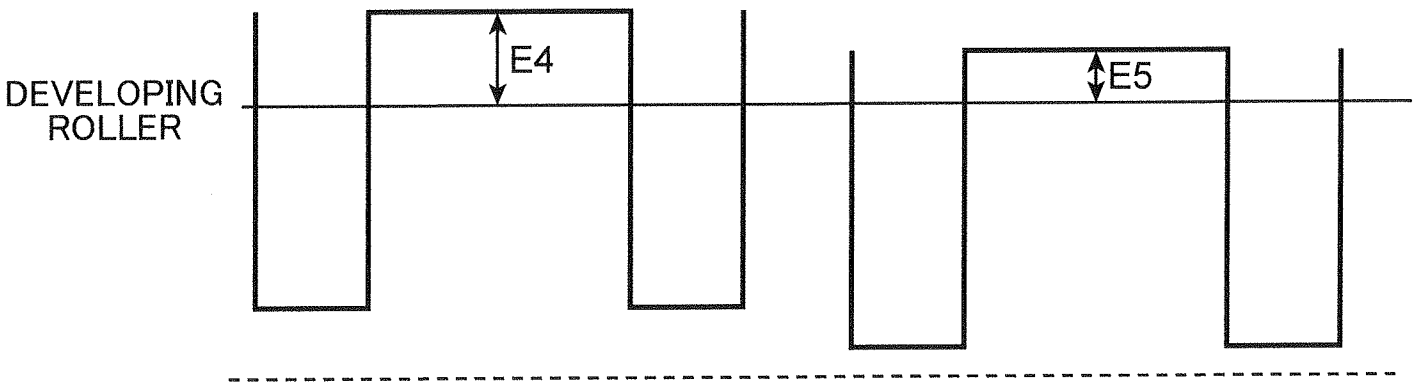
FIGS. 11A and 11B are time charts showing examples of bias waveforms between standard sized sheets and between long sheets.

FIGS. 11A and 11B shows modifications of stripping biases applied at the interval between sheets, wherein FIG. 11A shows a first stripping bias Bc1 applied at the interval between sheets after the printing process for a standard sized sheet is performed and FIG. 11B shows a second stripping bias Bc2 applied at the interval between sheets after the printing process for a long sheet is performed. A potential difference E5 (fifth potential difference) set in the second stripping bias Bc2 is smaller than a potential difference E4 (fourth potential difference) between the magnetic roller 82 and the developing roller 83 set in the first stripping bias Bc1.

If the stripping biases are changed in this way, a force for stripping toner particles by an electrical force acting toward the magnetic roller 82 can be strengthened at the interval between sheets after the transfer process for a long sheet is completed. Thus, even if toner particles are relatively firmly carried on the developing roller 83 in the printing process for the long sheet, the toner particles can be collected in a satisfactory manner from the developing roller 83 by the strengthened stripping force.

The above first stripping bias Bc1 can have the same values as the example of the above stripping bias Bc.

DC bias Vmag_dc of the magnetic roller 82; 150 V

DC bias Vslv_dc of the developing roller 83; 50 V

Note that the AC biases Vmag_ac, Vslv_ac and the duty ratios are the same as the first developing bias Bb1.

On the other hand, an example of the second stripping bias Bc2 is as follows. Note that the AC biases Vmag_ac, Vslv_ac and the duty ratios are the same as the first developing bias Bb1.

DC bias Vmag_dc of the magnetic roller 82; 100 V

DC bias Vslv_dc of the developing roller 83; 50 V

Application examples of the above first and second stripping biases Bc1, Bc2 are described based on the printing examples shown in FIGS. 8A to 8C. Since the example of FIG. 8A is an example of successively printing the standard sized sheets S11, S12 and S13, the bias applied during the inter-sheet intervals D11, D12 is the first stripping bias Bc1. Since the long sheets S22, S21 are successively printed in the example of FIG. 8B, the bias applied during the inter-sheet intervals D21, D22 is the second stripping bias Bc2. In the example of FIG. 8C, the long sheet 21 is printed after the printing of the standard sized sheet S1. Thus, the first stripping bias Bc1 is applied during the inter-sheet interval D23 and the second stripping bias Bc2 is applied during the inter-sheet interval D24.

Note that the bias controller 94 executes the above bias application control independently for each of the image forming units 32Y, 32M, 32C and 32Bk (first and second image forming units for forming toner images of first and second colors). That is, the blank area determiner 92 determines the presence or absence of the blank area in the image data for each color of yellow, magenta, cyan and black and the bias controller 94 causes the stripping operation to be performed for each of the image forming units 32Y, 32M, 32C and 32Bk. Thus, the occurrence of an image defect of each color can be suppressed in the image forming apparatus 1 for forming a full-color toner image as in this embodiment.

Figure 12:
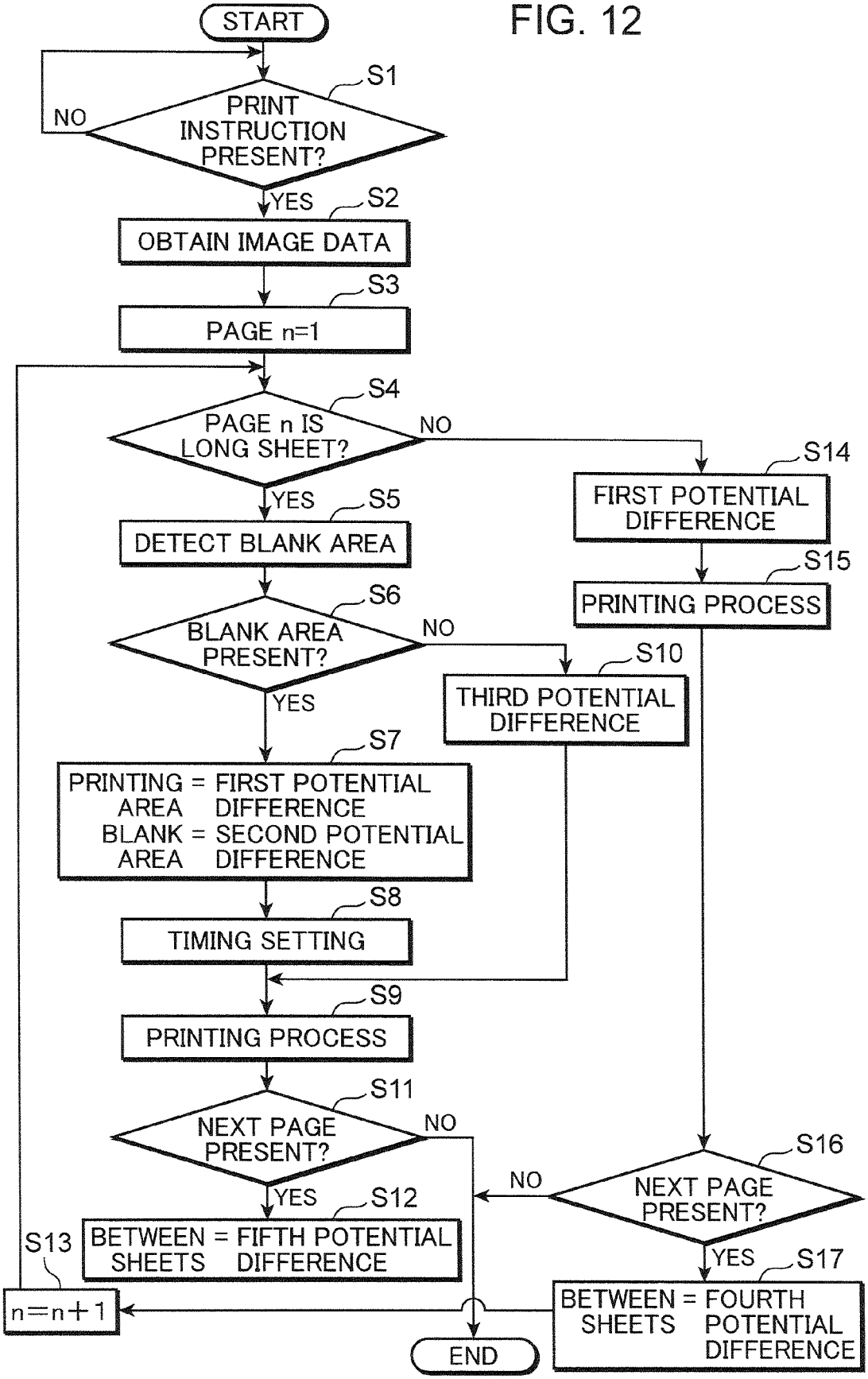
FIG. 12 is a flow chart showing a bias setting operation by the control unit.

FIG. 12 is a flow chart showing an example of a bias setting operation by the control unit 90. Here is supposed a case where the image forming apparatus 1 operates as a printer. Further, a case where the bias control shown in FIG. 11 is applied at an interval between sheets is illustrated. Note that the bias setting operation performed for one of the image forming units 32Y, 32M, 32C and 32Bk is illustrated here.

First, it is determined whether or not a print instruction has been given from an external apparatus to the control unit 90 via the I/F 964 (Step S1). If no print instruction has been given (NO in Step S1), this routine waits on standby.

If the print instruction has been given (YES in Step S1), image data is written in the image memory 963 (Step S2). Then, a counter indicating a page number is set at n=1 (Step S3). Thereafter, the image data is referred to by the sheet size discriminator 91 and it is determined whether or not the first page image data of the image data is standard sized sheet data or long sheet data (Step S4).

If the sheet size discriminator 91 determines the "long sheet data" (YES in Step S4), a process of detecting a blank area in this page image data is subsequently performed by the blank area determiner 92 (Step S5) and it is determined whether or not there is any blank area of the predetermined length or longer in the sub scanning direction (e.g. more than one turn of the circumferential surface 83A of the developing roller 83) (Step S6).

In the presence of the above blank area (YES in Step S6), the bias controller 94 refers to the potential difference storage 95 and sets the first developing bias Bb1 described above, with which the potential difference between the magnetic roller 82 and the developing roller 83 is the first potential difference, for the printing area of the long sheet and sets the stripping bias Bc having the second potential difference smaller than the first potential difference for the blank area (Step S7).

Subsequently, the timing setter 93 calculates a developing bias changing timing based on coordinate information of the blank area on the image data (Step S8). That is, a changing timing from the first developing bias Bb1 to the stripping bias Bc or an opposite changing timing according to a distribution of the blank area and the printing area in the sub scanning direction is specified during the printing of one long sheet. Thereafter, the printing process is performed on the long sheet for the page image data for the long sheet (Step S9).

On the other hand, in the absence of the above blank area (NO in Step S6), the bias controller 94 sets the second developing bias Bb2 having the third potential difference which is larger than the first potential difference by the predetermined value and enables a thicker toner layer to be formed on the circumferential surface 83A of the developing roller 83 (Step S10). Thereafter, the printing process is performed on the long sheet for the page image data for the long sheet (Step S9).

Thereafter, the control unit 90 confirms whether or not the page image data of the next page is stored in the image memory 963 (Step S11). In the presence of the image data of the next page (YES in Step S11), the bias controller 94 sets a bias applied between sheets from the completion of the printing process for the previous sheet (first sheet) to the start of the printing process for the next sheet (second sheet). Since the sheet on which the printing process was performed immediately before is the long sheet in this case, the bias applied at the interval between sheets is set at the stripping bias Bc2 having the fifth potential difference smaller than the fourth potential difference between the magnetic roller 82 and the developing roller 83 in the case of a standard sized sheet (Step S12).

Thereafter, the page number counter is incremented by 1 (Step S13) and a return is made to Step S4 to repeat the process. In the absence of the page image data of the next data (NO in Step S11), the process is finished.

On the other hand, if the sheet size discriminator 91 determines the "standard sized sheet data" in Step S4 (NO in Step S4), the bias controller 94 sets the developing bias Ba1 having the first potential difference (Step S14). Thereafter, the printing process is performed on the standard sized sheet for the page image data for the standard sized sheet (Step S15).

Thereafter, the control unit 90 confirms whether or not the page image data of the next page is stored in the image memory 963 (Step S16). In the presence of the image data of the next page (YES in Step S16), the bias controller 94 sets a bias applied at the interval between sheets at the stripping bias Bc1 having the fourth potential difference (Step S17) since the sheet on which the printing process was performed immediately before is the standard sized sheet. Thereafter, the page number counter is incremented by 1 (Step S13) and a return is made to Step S4 to repeat the process. In the absence of the page image data of the next data (NO in Step S16), the process is finished.

As described above, according to the image forming apparatus 1 of this embodiment, the occurrence of an image defect associated with the deterioration of toner particles can be prevented in the image forming apparatus 1 capable of transferring a toner image to a long sheet. That is, if the long sheet includes a blank area of the predetermined length or longer in performing the printing process on the long sheet, the stripping operation is performed at a developing timing of an electrostatic latent image corresponding to the blank area. The toner particles are not supplied from a toner bearing member to an image bearing member at the developing timing of the blank area. In other words, since a toner layer needs not be kept on the toner bearing member, there is no influence on image formation even if toner particles are stripped from the toner bearing member at this timing. Since the stripping operation of collecting the toner particles from the developing roller 83 is performed at the developing timing of that blank area, the stay of the deteriorated toner particles on the circumferential surface 83A of the developing roller 83 can be suppressed. This can prevent the toner particles on the toner bearing member from being excessively charged during the transferring process for one long sheet and improve the developing property for the photoconductive drum 321.

As described above, according to the present disclosure, it is possible to prevent the occurrence of an image defect associated with the deterioration of toner particles in an image forming apparatus capable of transferring a toner image to a long sheet.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

an image bearing member for bearing an electrostatic latent image and a toner image to be transferred to a sheet;

a developer housing for storing a developer containing toner particles and carrier particles;

a developer bearing member for receiving the developer in the developer housing and bearing a developer layer while rotating in a predetermined direction;

a toner bearing member for receiving the toner particles from the developer layer and bearing a toner layer while rotating in contact with the developer layer and supplying the toner particles of the toner layer to the image bearing member to develop the electrostatic latent image;

a bias applying unit for applying a bias at least to one of the developer bearing member and the toner bearing member to form a predetermined potential difference between the both;

a separating unit for performing a stripping operation of forcibly returning residual toner particles not supplied to the image bearing member and carried on the toner bearing member to the developer bearing member by utilizing the bias applying unit;

a sheet size discriminator for discriminating whether the sheet to which the toner image is to be transferred is a standard sized sheet or a long sheet, the size of which in a sub scanning direction is longer than the standard sized sheet;

a determiner for determining whether or not there is any blank area of a predetermined length or longer in the sub scanning direction where no toner image is to be substantially transferred based on image data, from which the toner image is to be formed, for each long sheet; and a controller for controlling the stripping operation by controlling the bias applying unit, wherein:

the controller causes the separating unit to perform the stripping operation at a developing timing of the electrostatic latent image corresponding to the blank area to be formed on the image bearing member when the sheet size discriminator discriminates the sheet, to which the toner image is to be transferred, to be the long sheet and when the determiner determines the presence of the blank area of the predetermined length or longer, in a transferring process for the long sheet, the controller sets:

the bias so that the potential difference between the developer bearing member and the toner bearing member becomes a predetermined first potential difference at a developing timing of the electrostatic latent image corresponding to a printing area where the toner image is to be transferred, and the potential difference between the developer bearing member and the toner bearing member at a second potential difference at which toner particles on the toner bearing member can be collected onto the developer bearing member by an electrical force by making the potential difference different from the first potential difference by a predetermined value at the developing timing of the electrostatic latent image corresponding to the blank area, and the controller causes the stripping operation to be performed also between a transferring process for a first sheet and that for a second sheet following the first sheet, sets the bias so that the potential difference between the developer bearing member and the toner bearing member becomes a third potential difference when the first sheet is the standard sized sheet and sets the bias so that the potential difference between the developer bearing member and the toner bearing member becomes a fourth potential difference smaller than the third potential difference when the first sheet is the long sheet.

2. An image forming apparatus according to claim 1, wherein:

the predetermined length of the blank area in the sub scanning direction is the circumferential length of one turn of the toner bearing member.

3. An image forming apparatus according to claim 1, wherein:

the controller sets the potential difference between the developer bearing member and the toner bearing member at a fifth potential difference which is larger than the first potential difference by a predetermined value and enables a thick toner layer to be formed on the toner bearing member during the transferring process for the long sheet when the determiner determines the absence of the blank area of the predetermined length or longer for one long sheet.

4. An image forming apparatus according to claim 1, further comprising at least a first image forming unit and a second image forming unit each including the image bearing member, the developer housing, the developer bearing member and the toner bearing member and adapted to form toner images of a first color and a second color different from each other, wherein:

the determiner determines the blank area in the image data for each of the first and second colors; and the controller causes the stripping operation to be independently performed for each of the first and second image forming units.

5. An image forming apparatus, comprising:

an image bearing member for bearing an electrostatic latent image and a toner image to be transferred to a sheet;

a developer housing for storing a developer containing toner particles and carrier particles;

a developer bearing member for receiving the developer in the developer housing and bearing a developer layer while rotating in a predetermined direction;

a toner bearing member for receiving the toner particles from the developer layer and bearing a toner layer while rotating in contact with the developer layer and supplying the toner particles of the toner layer to the image bearing member to develop the electrostatic latent image;

a bias applying unit for applying a bias at least to one of the developer bearing member and the toner bearing member to form a predetermined potential difference between the both;

a separating unit for performing a stripping operation of forcibly returning residual toner particles not supplied to the image bearing member and carried on the toner bearing member to the developer bearing member by utilizing the bias applying unit;

a sheet size discriminator for discriminating whether the sheet to which the toner image is to be transferred is a standard sized sheet or a long sheet, the size of which in a sub scanning direction is longer than the standard sized sheet;

a determiner for determining whether or not there is any blank area of a predetermined length or longer in the sub scanning direction where no toner image is to be substantially transferred based on image data, from which the toner image is to be formed, for each long sheet; and a controller for controlling the stripping operation by controlling the bias applying unit, wherein:

the controller causes the separating unit to perform the stripping operation at a developing timing of the electrostatic latent image corresponding to the blank area to be formed on the image bearing member when the sheet size discriminator discriminates the sheet, to which the toner image is to be transferred, to be the long sheet and when the determiner determines the presence of the blank area of the predetermined length or longer, the controller causes the stripping operation to be performed also between a transferring process for a first sheet and that for a second sheet following the first sheet, sets the bias so that the potential difference between the developer bearing member and the toner bearing member becomes a first potential difference when the first sheet is the standard sized sheet and sets the bias so that the potential difference between the developer bearing member and the toner bearing member becomes a second potential difference smaller than the first potential difference when the first sheet is the long sheet.

* * * * *